US007769538B2

(12) United States Patent
Rousseau

(10) Patent No.: US 7,769,538 B2
(45) Date of Patent: Aug. 3, 2010

(54) METHOD AND SYSTEM FOR DETERMINING THE POSITION OF AN OBJECT MOVING ALONG A COURSE

(75) Inventor: Michel Rousseau, Verviers (BE)

(73) Assignee: Alstom Belgium S.A., Charleroi (BE)

( * ) Notice: Subject to any disclaimer, the term of this patent is extended or adjusted under 35 U.S.C. 154(b) by 782 days.

(21) Appl. No.: 10/591,851

(22) PCT Filed: Mar. 3, 2005

(86) PCT No.: PCT/EP2005/002372

§ 371 (c)(1),
(2), (4) Date: Sep. 5, 2006

(87) PCT Pub. No.: WO2005/095174

PCT Pub. Date: Oct. 13, 2005

(65) Prior Publication Data

US 2007/0203640 A1 Aug. 30, 2007

Related U.S. Application Data

(60) Provisional application No. 60/550,757, filed on Mar. 5, 2004.

(30) Foreign Application Priority Data

Sep. 29, 2004 (EP) ..... 04447215

(51) Int. Cl.
*G01C 21/00* (2006.01)

(52) U.S. Cl. ..... 701/207

(58) Field of Classification Search ..... 701/200–202, 701/207, 213–215; 340/988; 342/357.06
See application file for complete search history.

(56) References Cited

U.S. PATENT DOCUMENTS

| | | | | |
|---|---|---|---|---|
| 5,548,516 | A * | 8/1996 | Gudat et al. | 701/200 |
| 5,884,218 | A * | 3/1999 | Nimura et al. | 701/208 |
| 5,893,043 | A | 4/1999 | Moehlenbrink et al. | 701/207 |

FOREIGN PATENT DOCUMENTS

| | | | |
|---|---|---|---|
| EP | 0825418 | A2 | 2/1998 |
| EP | 0881136 | A2 | 12/1998 |
| WO | WO 02/03094 | A2 | 1/2002 |

OTHER PUBLICATIONS

Kiriczi et al., "Signaltechnisch sichere Fehlergrenzen fuer die Erfassung der Bewegungszustaende von Bahnen" Fortschritt-Berichte VDI: Reihe 8, Mess-Steuerungs—und Regelungstechnik, VDI, 1996, pp. 141-155. ISSN: 0178-9546, See also International Search Report.

* cited by examiner

*Primary Examiner*—Yonel Beaulieu
(74) *Attorney, Agent, or Firm*—Davidson, Davidson & Kappel, LLC

(57) ABSTRACT

The position of an object moving along a course is determined by a relative measured position while its associated second confidence interval is smaller than a first confidence interval associated with an absolute measured position and is determined by the absolute position when the second confidence interval exceeds the first confidence interval.

10 Claims, 1 Drawing Sheet

METHOD AND SYSTEM FOR DETERMINING THE POSITION OF AN OBJECT MOVING ALONG A COURSE

BACKGROUND

The present invention relates to a method for securely determining the position of an object moving along a course which is known by the location device.

The term "course" is intended to mean a subset of the space delimited by a tubular surface of arbitrary and variable cross section, in which the vehicle is strictly constrained to move. In the event that the cross section of this tube can be neglected, this gives two equations linking longitude, latitude and altitude of the moving object.

The present invention relates more precisely to a method for determining the location of a train moving on a railway track of which the exact path is known.

The present invention relates to a method for determining the location and/or the positioning of a vehicle in terms of railway transport security. It involves being able to determine in a quasi-instantaneously way and with a given probability the location of a vehicle moving on a known course, or more precisely the zones of non-presence of said vehicle on a section.

In railway signalling, a train is not allowed to enter a specific section of track until it is certain that the train in front has departed therefrom, i.e. the track section in question is free. To that end, it is necessary to ascertain with a predetermined, extremely small margin of error (for example with a maximum error level in the order of $10^{-9}$ and preferably in the order of $10^{-12}$) the zones in which non-presence of a train can be relied upon, and to do so at each iteration of the calculation.

It is known to determine the precise location of a vehicle, and in particular of a train, with trackside detection devices (track circuits, axle counters, . . . ) for train detection purposes.

It is also known to use train borne train position determination systems for fail safe train control purposes. These train position determination systems are based on train borne sensors (wheel sensors, radars, . . . ) which give the relative position of the train with reference to trackside location materialised by trackside installed beacons (or equivalent devices). These trackside reference points are required because of the nature of the applied sensors, in order to allow resetting the error accumulated by the train location system over time (radars) and/or distance (wheel sensors).

Those solutions have important impact on the life cycle cost of a train control/command system:

- Trackside detection systems have important acquisition, installation and maintenance cost, due to the quantity of equipment to be installed and their connection by cable to an interlocking system.
- Existing train borne solutions, based on wheel sensors and/or radar sensors also have important acquisition, installation and maintenance costs, mainly due to their location as they are mounted below the locomotive.

The position of a vehicle can be determined using a satellite communication system by means of a GNSS (Global Navigation Satellite System) like GPS, GLONASS, and the future Galileo system. WO 02/03094 discloses a method for secure determination of an object location, preferably a vehicle moving along a known course. This method takes advantage of the deterministic trajectory of the train to reach an optimal compromise between safety, availability and accuracy. However, this system cannot provide a higher accuracy where needed, e.g. near stations or crossings.

EP-0825418 A2 discloses the use of several sensors to determine the position of a train. Data relating to position and error interval from several sensors, comprising beacons and GPS, is used to determine the position of the train. However, this system implies a calculation involving severals operations including integration. It is therefore considered as complex.

SUMMARY OF THE INVENTION

It is therefore an aim of the present invention to provide a method and a device which permits secure location and/or positioning of an object, and thus a fortiori of a vehicle such as a train, moving on a known course.

The term secure location is intended to mean the location, or more exactly the non-presence of a train outside a zone which is redefined at each calculation, with a error level of less than $10^{-9}$ and preferably capable of reaching $10^{-12}$.

Another aim of the invention is to improve the localisation accuracy of a train, and to improve the throughput performance of a course such as a railway line.

Others aims of the invention are to improve the life cycle cost of a train/command system, to reduce the amount of equipments installed below the locomotive, to reduce the amount of equipments installed along the tracks.

The present invention provides a method for determining the location and/or the positioning of an object, in particular a vehicle such as a train, moving along a known course, and this securely in terms of railway transport. The method comprises the steps of

- determining an absolute position of the object with a first confidence interval,
- determining a relative position of the object with a second confidence interval,
- selecting the smaller confidence interval among the first and second confidence interval,
- determining the location and/or positioning of the object by means of the position corresponding to said smaller confidence interval.

Preferably said absolute position is determined by a railway-safe positioning method involving a digital mapping of the possible trajectories, and at least one satellite communication receiver, e.g. a GNSS receiver or an equivalent device.

In a preferred embodiment, said relative position may be calculated by detecting the presence of a beacon, and by integrating the speed of the object, with reference to the location of said beacon.

Preferably, said speed is calculated via the GNSS Doppler signal.

In a typical embodiment the first confidence interval for the absolute position may be in the order of 50 m.

In another object the present invention is also related to a location device implementing the method as previously described.

SHORT DESCRIPTION OF THE DRAWINGS

DETAILED DESCRIPTION OF A PREFERRED EMBODIMENT

The present invention will be described with reference to a train moving on a track, but it must be understood that it can be generalised within the terms of the claims.

Figure 1:
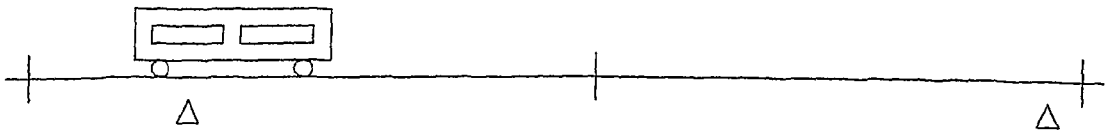
FIG. 1 represents trains using the invention.

FIG. 1 shows a train moving on a track. The track is subdivided in sections, and when the train leaves a section, another train can be allowed to enter this section. Therefore the position of the train needs to be determined.

This position is determined, in terms of railway safety, with absolute error length, called confidence interval. This means that the train is in the confidence interval with a probability of error of less than $10^{-9}$ and preferably of less than $10^{-12}$. The smaller the confidence interval, the sooner the section can be used by another train. The line/track throughput is therefore improved.

The train is equipped with an absolute position determining system (APDS). The APDS includes access to a digital mapping of the possible trajectories, such as a device with access to a digital map of possible railway trajectories, and at least one GNSS receiver or equivalent device. The APDS allows to determine the position of the train, with a confidence interval of around 50 m. This can be achieved by applying the method described in WO 02/03094.

The train is also equipped with a relative position determining system (RPDS). The RPDS includes means for detecting the presence of a beacon along the track. When a beacon is detected, the RPDS knows that the position of the train corresponds to the position of the beacon, with a confidence interval of for example around 5 m. The position of the beacon can be sent by the beacon itself, or stored in a database accessible from the train. The RPDS also includes means to measure the speed of the train. Those means can be for instance the GNSS equipment of the APDS, allowing a speed determination by the GNSS Doppler signal.

The relative position is calculated by the RPDS by integrating the speed of the train, with reference to the position of the beacon. The confidence interval, which is very small when a beacon has just been passed, increases with the movement of the train because of the accumulation of errors.

The APDS and the RPDS are part of a train borne location system. The train borne location system determines the position of the train according to the method of the invention.

Figure 2:
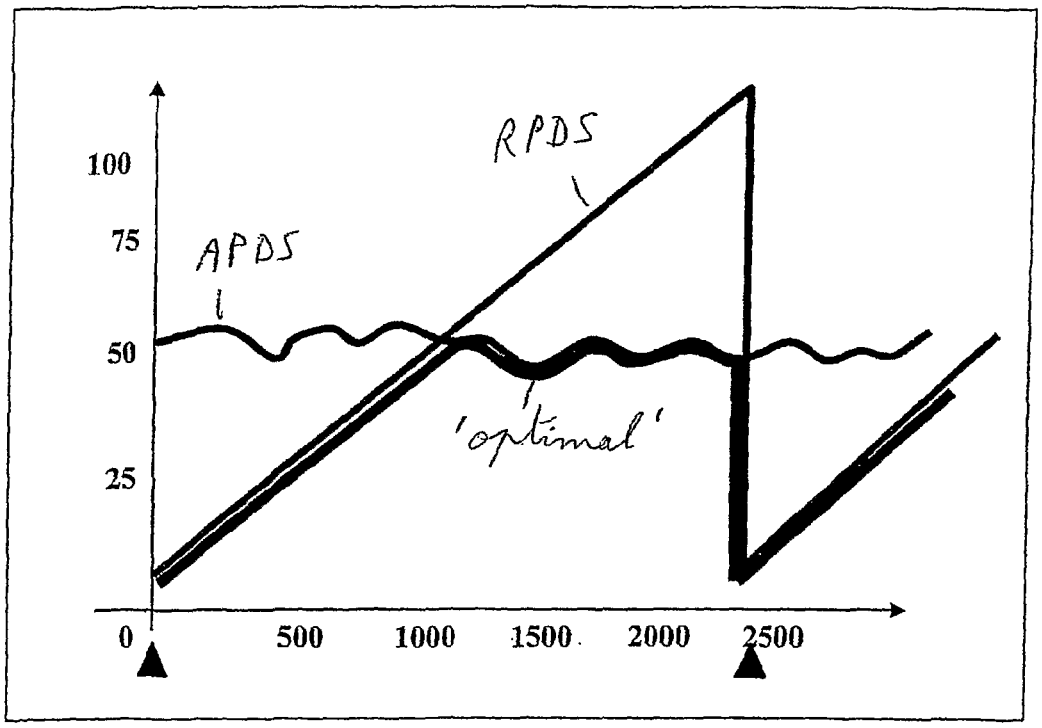
FIG. 2 represents a graph showing the principles of the invention.

The principle of the invention is shown FIG. 2. The confidence interval of the position a train moving on a track is shown with respect to the distance ran by the train. A first curve ('APDS') shows the confidence interval of the APDS. The confidence interval is in this example about 50 meter. A second curve ('RPDS') shows the confidence interval of the RPDS. When a first beacon is passed, the confidence interval is of for example from 1 to 5 m. When the train moves further on, the confidence interval increases, due to the accumulation of errors, until another beacon is met.

A method of the invention includes determining the position of the train according to the following principle: each time a beacon is met by the train, the train borne location system operates in an beacon augmented mode, using the RPDS: the beacon position is used as a reference and the actual train position is computed with reference to this beacon, by integrating the actual speed of the train. When the accuracy provided in this way falls under the accuracy provided by the APDS, or, in other words, when the confidence interval provided by RPDS exceeds the confidence interval one can achieve with APDS, the train borne location system stops using the beacon augmented mode information and switches to the use of the APDS. It then keeps operating in APDS mode until a next beacon is met.

As a result, the position of the train is determined with a confidence interval shown by the 'optimal' curve in FIG. 2.

The present invention allows to determine the position of a train with a high accuracy by placing beacons where needed, for example near stations or crossings of tracks, and with a good accuracy and without the need of beacons, where such a higher accuracy is not needed.

The invention claimed is:

1. A method for securely determining a position of an object moving along a known course, with respect to a distance run by the moving object, comprising steps of:

determining an absolute position of the object with a first confidence interval;

determining a relative position of the object with a second confidence interval;

selecting a smaller confidence interval among the first and second confidence intervals when the object is moving along the course, with respect to the distance run by the moving object;

determining the location and/or positioning of the object using the relative position while the second confidence interval is the smaller interval; and determining the location and/or position of the object using the absolute position while the first confidence interval is the smaller confidence interval.

2. The method as recited in claim 1 wherein the object is a vehicle.

3. The method as recited in claim 2 wherein the vehicle is a train.

4. The method as recited in claim 1 wherein the step of determining the absolute position includes a railway-safe positioning method involving a digital mapping of possible trajectories and at least one satellite communication receiver.

5. The method as recited in claim 4 wherein the at least one satellite communication receiver is a GNSS receiver.

6. The method as recited in claim 1 wherein the step of determining a relative position includes detecting the presence of a beacon and integrating a speed of the object with reference to a location of the beacon.

7. The method as recited in claim 6 wherein the speed is calculated via a GNSS Doppler signal.

8. The method as recited in claim 1 wherein the first and second confidence intervals determine the position of the object with an error probability less than $10^{-9}$.

9. The method as recited in claim 8 wherein the error probability is in the order of $10^{-12}$.

10. The method as recited in claim 1 wherein the first confidence interval for the absolute position is in the order of 50 m.

* * * * *